US008678345B2

(12) United States Patent
Gum

(10) Patent No.: US 8,678,345 B2
(45) Date of Patent: Mar. 25, 2014

(54) VARIABLE ORIFICE GAS FLOW MODULATING VALVE

(76) Inventor: Mike Gum, West Plains, MO (US)

( * ) Notice: Subject to any disclaimer, the term of this patent is extended or adjusted under 35 U.S.C. 154(b) by 171 days.

(21) Appl. No.: 13/224,656

(22) Filed: Sep. 2, 2011

(65) Prior Publication Data

US 2012/0001106 A1 Jan. 5, 2012

Related U.S. Application Data

(63) Continuation-in-part of application No. 11/751,854, filed on May 22, 2007, now Pat. No. 8,028,968.

(51) Int. Cl.
*F16K 51/00* (2006.01)

(52) U.S. Cl.
USPC ..... 251/117; 251/122; 137/601.19; 236/1 A; 236/26 A

(58) Field of Classification Search
USPC ..... 251/117, 118, 120–122, 209, 903; 137/601.16, 601.18, 601.19, 599.17; 431/280; 236/1 A, 15 R, 20 R, 26 A
See application file for complete search history.

(56) References Cited

U.S. PATENT DOCUMENTS

| | | | | | |
|---|---|---|---|---|---|
| 1,185,970 | A | | 6/1919 | Bower | |
| 1,525,733 | A | | 2/1925 | Haskell | |
| 1,759,892 | A | * | 5/1930 | Doen | 137/613 |
| 1,921,761 | A | * | 8/1933 | Leins | 251/122 |
| 2,450,446 | A | * | 10/1948 | Rupp | 251/117 |
| 2,514,503 | A | | 7/1950 | Mueller | |
| 2,514,506 | A | * | 7/1950 | Mueller | 137/599.16 |
| 2,543,189 | A | * | 2/1951 | Mueller | 137/601.16 |
| 2,590,569 | A | * | 3/1952 | Peterson | 137/599.17 |
| 2,694,412 | A | * | 11/1954 | Jaros | 137/599.17 |
| 2,781,779 | A | * | 2/1957 | Kindl | 137/601.16 |
| 2,963,042 | A | * | 12/1960 | Dolby et al. | 137/628 |
| 2,984,256 | A | * | 5/1961 | Wildern | 137/613 |
| 3,084,865 | A | | 4/1963 | Fleer | |
| 3,090,423 | A | | 5/1963 | Garner | |
| 3,233,830 | A | * | 2/1966 | Branson et al. | 236/99 R |
| 3,402,739 | A | * | 9/1968 | Kass | 137/628 |
| 4,862,917 | A | | 9/1989 | Genbauffe | |
| 4,930,488 | A | | 6/1990 | Pearman | |
| 4,947,891 | A | | 8/1990 | Genbauffe | |
| 5,009,393 | A | | 4/1991 | Massey | |
| 5,027,854 | A | * | 7/1991 | Genbauffe | 137/599.17 |
| 5,234,196 | A | | 8/1993 | Harris | |
| 5,238,398 | A | | 8/1993 | Harris | |
| 5,249,773 | A | | 10/1993 | Feld | |
| 5,458,294 | A | | 10/1995 | Zachary | |
| 5,979,484 | A | | 11/1999 | Grando | |
| 6,029,705 | A | | 2/2000 | Happe | |
| 6,287,108 | B1 | | 9/2001 | Rothenberger | |

(Continued)

*Primary Examiner* — John K Fristoe, Jr.
*Assistant Examiner* — Marina Tietjen

(57) ABSTRACT

A temperature control system for a gas appliance utilizes an improved variable orifice gas flow modulating valve capable of direct modulation of gas flow through an orifice directly into a gas burner to provide a constantly maintained temperature in an appliance working compartment, as selected by human interface via a temperature selector. An actuator attached to a gas fitting body of the valve provides for linear movement of a metering pin into the taper inside the orifice, accomplishing the variable controlled modulated flow of gas directly into the burner. The actuator is controlled by an input signal from a programmable controller whose output is determined by calculations based on inputs from a temperature selector and a temperature sensor located in the gas appliance working compartment.

13 Claims, 13 Drawing Sheets

(56) References Cited

U.S. PATENT DOCUMENTS 6,968,853 B2 11/2005 Amazorrain
7,201,186 B2 4/2007 Ayastuy
7,287,551 B2 10/2007 James
7,458,386 B2 * 12/2008 Zhang ..... 137/15.18

* cited by examiner 54
58
170
176
178
182
198
198
208
210
212
214
216
216
218
220
220
222
224
172

VARIABLE ORIFICE GAS FLOW MODULATING VALVE

RELATED APPLICATION

The present application is a continuation-in-part patent application and claims priority benefit, with regard to all common subject matter, of earlier-filed U.S. nonprovisional patent application titled "VARIABLE ORIFICE GAS FLOW MODULATING VALVE", Ser. No. 11/751,854, filed May 22, 2007. The identified earlier-filed application is hereby incorporated by reference into the present application.

BACKGROUND

1. Field

Embodiments of the present technology relate to gas valves for use in gas appliances. More particularly, embodiments of the technology involve a variable gas valve for modulating a flow of gas into a burner of a gas appliance.

2. Description of Related Art

Gas valves are used to regulate an amount of gas fed to a gas appliance such as, for example, an oven, furnace, hot water heater, or fireplace. Gas valves have traditionally had two settings, on and off. Use of such valves causes undesirable fluctuations in appliance output. An oven set at 350° for example, may fluctuate between 345° and 355° as the oven temperature control cycles through on at 345°, off at 355°, and then back on at 345°.

To address the problem of output fluctuation in gas appliances, variable gas valves were developed to modulate gas flow across a range of outputs instead of between an on position and an off position. Such variable gas valves enable output control systems to operate with less fluctuation than a traditional on/off type gas valve.

U.S. Pat. Nos. 6,968,853; 6,029,705; and 5,979,484 all provide gas flow modulation by regulating the pressure of the fuel supplied to a fixed orifice. However, this method of gas flow modulation inherently causes a significant drop in pressure ahead of the orifice, resulting in a decrease in the velocity of the gas exiting the orifice, thus reducing the amount of primary air in atmospheric type burners, which negatively impacts the quality of flame and amount of complete combustion at the burner, increasing the volume of non-combusted materials in the flue gases exhausted to the atmosphere.

U.S. Pat. No. 4,930,488 provides a solenoid operated microprocessor-actuated modulating gas valve, operating in a similar manner as above by restricting flow between a poppet and outlet seat. However, even though this valve does include the outlet orifice on the valve, the flow restriction occurs at the outlet seat, thereby reducing the pressure to the fixed orifice.

U.S. Pat. No. 5,458,294 provides a variable orifice solenoid operated valve as a control device to meter gas flow as a function of sensed temperature and desired temperature. However, this design exhibits an undesirable amount of hysteresis and non-repeatability during operation depending on the particular sequence, length and direction of setting adjustments.

U.S. Pat. Nos. 5,249,773; 3,402,739; 3,090,423; and 3,084,865 all provide a gas valve employing a metering pin operating at the outlet orifice as a method of modulating the fuel flow into the burner. These type modulating valves overcome the aforementioned problem of reduced gas velocity due to pressure drop ahead of the orifice. However, these valves all use a solid metering pin in the outlet orifice which can produce a non-circular gas jet that may not provide for optimal combustion and maximum turndown.

U.S. Pat. No. 5,238,398 discloses a gas modulating valve for use with a gas burner. The valve accomplishes modulation through the use of two sliding plates positioned next to each other that have orifice holes that result in a reduced orifice passageway when the two plates are misaligned with each other. One of the two variations disclosed discharges a gas jet directly into the mixing tube of a gas burner, while the second variation operates as an in-line gas modulating valve. However, due to the nature of the two sliding plates, the gas discharge jet issuing from the variable orifice is neither perfectly centered in the mixer tube of the burner, nor is it perfectly round in cross-section.

Gas Research Institute, which owns U.S. Pat. No. 4,930,488 (the '488 Patent), was exceptionally skilled in the art and likewise did not find adequate teaching or motivation in the prior art to develop a gas modulating valve using the metering pin method operating at the outlet orifice as a method of modulating the fuel flow into the burner to solve a significant need in the industry. They were specifically tasked with a project to develop a microprocessor controlled temperature control system, citing significant needs in the industry. Specifically, " . . . the lack of an inexpensive and reliable microprocessor controllable gas valve . . . " where " . . . modulation of the gas flame has the advantage of tighter control of temperature . . . " In addition " . . . there is a need for gas flame modulation as well as enhanced functionality of the range."

As a pure research company representing the gas (including appliances) industry, one of their objectives was to develop a system that could be competitively manufactured and marketed for use in the gas industry. In addition, one of their guiding principles is to save gas through the development of improved, more efficient gas controls.

Gas Research Institute developed a solenoid operated modulating valve, having a flat seal operating on a valve seat just ahead of the outlet orifice. This 'free-floating' design is known to exhibit 'hunting', a condition where the valve will repeatedly close and open at a certain proximity of the valve to the exit hole. The condition can be seen illustrated in the displacement vs. current chart in FIG. 4 of the '488 Patent. The chart shows a 'gap open' from nearly zero to 0.06 inches. This is due to the coil force overcoming the force of the pressure differential across the closed valve and seat (exit), and then the spring pressure 'jerks' the valve further open once the valve breaks free from the seat and the pressure differential rapidly diminishes. The opposite will occur on trying to adjust to a low flow rate. As the valve approaches the seat, the velocity of the fuel flow and the increasing pressure differential will at a certain point 'jerk' the valve closed. This type actuator is incapable of modulation at low flow rates, thus there still remains 'a need' for an improved modulating valve as outlined in the application.

This type of device for positioning is well known in the art, and is known to exhibit excessive hysteresis and non-repeatability. This "hysteresis in the setting behavior" is specifically cited in U.S. Pat. No. 6,287,108 Rothenberger (col. 1, line 45) as a problem in the prior art leading to a need for that invention. In addition, there are numerous known customer complaints regarding gas modulating valves and regulators using such type solenoid positioning devices due to the non-repeatability during operation.

SUMMARY OF THE INVENTION

Embodiments of the present invention provide an improved gas valve that does not suffer from the problems and limitations of the prior art. Particularly, embodiments of the present invention provide an improved metering pin and a variable orifice gas flow modulating valve.

The metering pin may comprise a sidewall, a head, and a plurality of fins. The sidewall may be of cylindrical shape and may include an axially-aligned center hole extending the length of the sidewall and a lateral hole extending from the exterior of the sidewall to the center hole. The head may be coupled to the sidewall and may have a tapered frustoconical shape with a planar endwall that includes an exit hole that couples to the center hole. The fins may be coupled to the sidewall with each fin having a first end aligned with one end of the sidewall and a second end with a taper that aligns with the taper of the head.

The variable orifice gas flow modulating valve may comprise an orifice hood, a gas fitting body, the metering pin, and an actuator. The orifice hood may include an outlet orifice of small diameter that extends from the exterior of the orifice hood to the interior thereof, an internal bore having a relatively larger diameter, and an internal countersink having a taper that couples the outlet orifice to the internal bore. The gas fitting body may include a gas inlet port and an internal passageway connected thereto. The internal passageway may be aligned with and coupled to the internal bore of the orifice hood. The metering pin may include the features described above. The actuator may be coupled to the metering pin and operable to move the metering pin along the internal passageway and the internal bore.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWING FIGURES

Preferred embodiments of the present invention are described in detail below with reference to the attached drawing figures, wherein.

DETAILED DESCRIPTION OF THE PREFERRED EMBODIMENTS

Figure 1:
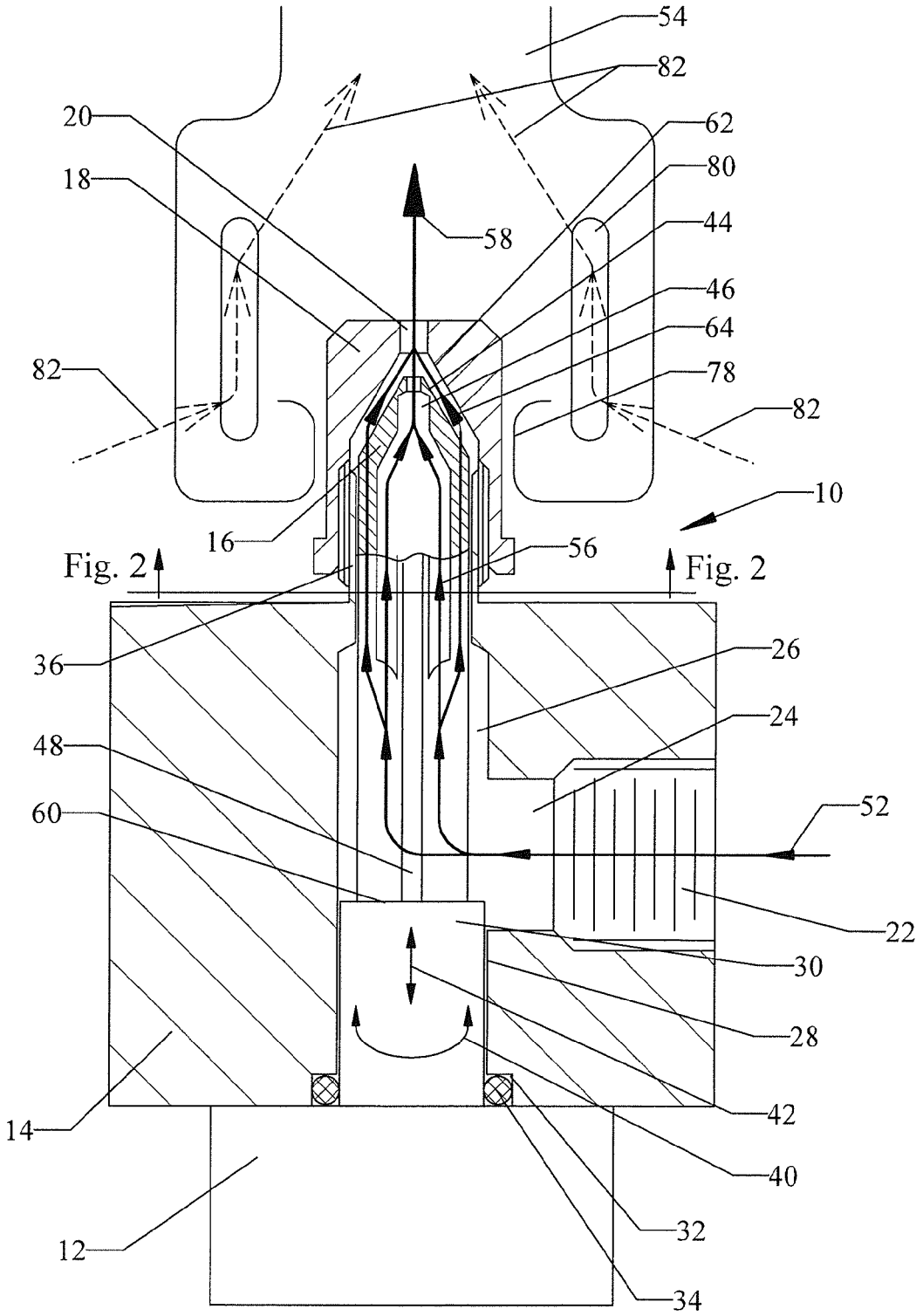
FIG. 1 is a side elevation view of a variable orifice gas flow modulating valve incorporating principles of the present technology according to a first implementation.

A gas valve incorporating principles of the present teachings according to a first implementation is illustrated in FIG. 1 and designated generally by the reference numeral 10. The gas valve 10 generally comprises an actuator 12, a gas fitting body 14, a metering pin 16, and an orifice hood 18. The actuator 12 causes the pin 16 to move relative to the fitting body 14 and the orifice hood 18 to vary an amount of gas passing through an outlet orifice 20.

Figure 2:
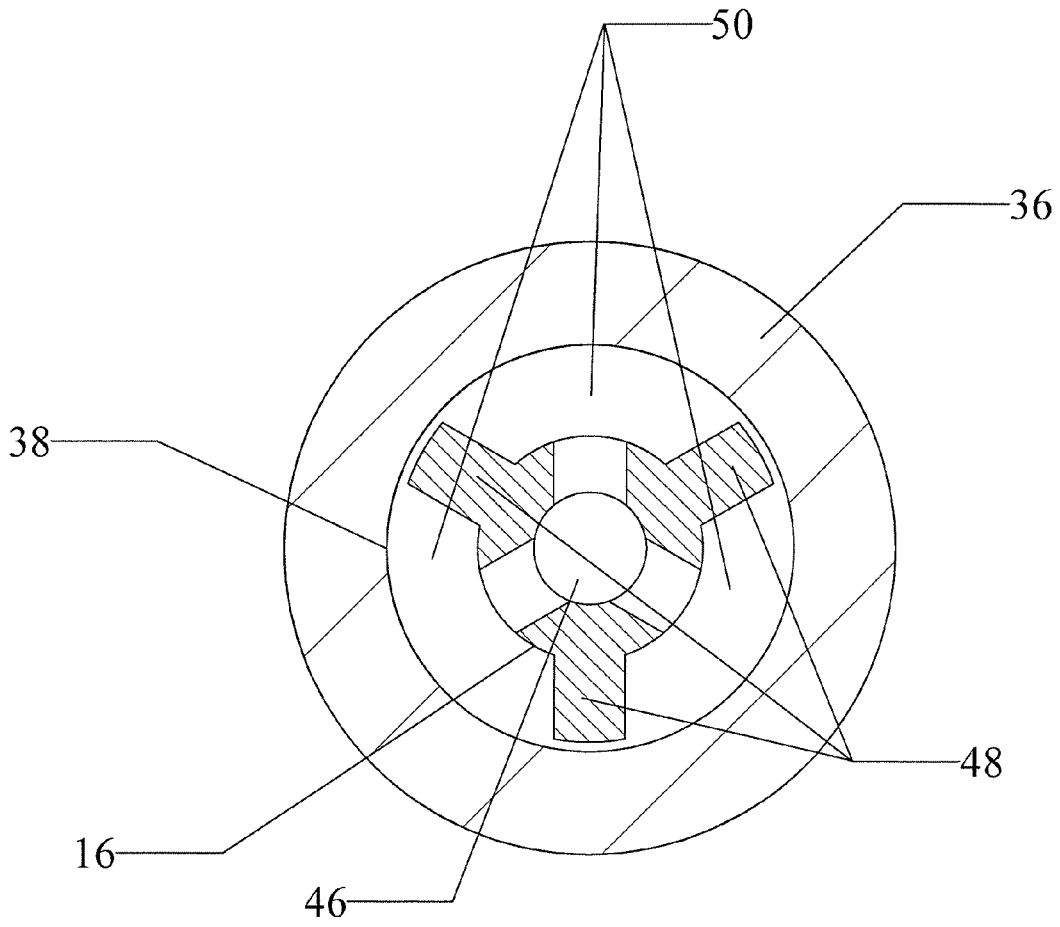
FIG. 2 is a cross-sectional view of a metering pin and a fitting outlet taken along line 2-2 of FIG. 1.

The gas fitting body 14 comprises a gas inlet connection 22 for connecting to a gas supply line, an internal passageway from the inlet connection 22 to the metering pin 16, the internal passageway including a first portion 24 and a second portion 26, a bore 28 for receiving and guiding a motor shaft 30 during operation, and a counterbore 32 adjacent the bore 28 for receiving an o-ring 34 to provide a gas-tight seal between the gas fitting body 14 and the actuator shaft 30. Referring also to FIG. 2, an outlet port 36 of the gas fitting body 14 generally extends into a recess of the orifice hood 18 and includes a precision-machined bore 38 for alignment of the metering pin 16. The outlet port 36 may further include external threads for engaging the orifice hood 18, as explained below in greater detail.

The actuator 12 may be a stepper motor or similar device and is securely attached to a first end of the gas fitting body 14 via traditional means including, for example, rivets, screws, bolts, welded links, or similar attachment means. The actuator shaft 30 operates axially through the bore 28. Thus, the bore 28 is preferably machined with a surface finish to provide adequate clearance and alignment of the shaft 30 during operation. Furthermore, surfaces of the shaft 30 and the counterbore 32 preferably have a high-quality surface finish sufficient for providing a gas-tight seal with the o-ring 34 placed around the shaft 30 and seated in the counterbore 32. Though not essential for operation, it may be desirable that the o-ring 34 be of such material, type, cross-sectional shape, coating and surface quality as to exceed all gas industry and associated certification agencies standards, specifications and requirements, taking into account that the shaft 30 will exhibit both rotational 40 and linear 42 movement during operation.

The metering pin 16 is generally elongated with a cylindrical central core extending substantially from a first end of the pin 16 adjacent the actuator shaft 30 to a metering end 44 of the pin 16. The cylindrical central core includes a bore or center hole 46 extending longitudinally from approximately a middle of the pin 16 to the metering end 44 of the pin 16. A plurality of fins 48 extend radially outwardly from the cylindrical central core, and extend axially from the first end of the pin 16 to the metering end 44 of the pin 16. The fins 48 generally define fluid passageways 50, such that in operation gas flows in the inlet connection 22 generally along path 52, through the internal passageway, along the gas passageways 50 defined by the fins 48 and indicated by path 56, and through the center hole 46, and ultimately out the orifice 20 into a burner 54 as indicated by path 58. While the illustrated pin 16 includes three fins 48 approximately equally radially spaced about the central core, it will be appreciated that virtually any number of fins may be used and spaced at unequal intervals.

While the fins 48 extend substantially the entire length of the pin 16, a radially-inward recess of each of the fins 48 extends from approximately a middle section of the pin 16 toward the metering end 44 of the pin 16. The recessed portion of the fins 48 and the center hole 46 provide an enlarged, central passage for gas to flow toward the metering end 44 of the pin 16.

The first end of the metering pin 16 is secured to the actuator shaft 30 by threading, press fit, weld, cross-pin, or some other similar attachment method, onto an end 60 of the shaft 30. Though not essential to use and operation of the present technology, it may be desirable that such attachment method exceed the life expectancy of all associated standards, specifications, and requirements.

The size of the fins 48 is sufficient to provide clearance within the bore 38 to allow for movement of the metering pin 16 during functional operation, while maintaining axial alignment with the orifice hood 18. The center hole 46 through the metering pin 16 provides for a central gas flow path to the outlet orifice 20 of the orifice hood 18. The metering end 44 of the metering pin 16, and an internal countersink 62 of the orifice hood 18, are both machined with matching angle tapers such that the gas flow at point 64 approaching the orifice 20 is gradually constricted, reducing or modulating the exiting gas flow 58, as the motor shaft 30 is operated to cause the metering end 44 to approach closer to the orifice hood countersink surface 62.

The actuator 12 moves the pin 16 between an open position where the metering pin 16 is separated from the tapered section of the countersink 62 by a distance and allows gas to flow around an outer surface of the tapered portion of the pin 16 to the outlet orifice 20, and a closed position where the tapered portion of the metering pin 16 is seated against the tapered section of the countersink 62 and restricts substantially all gas flow to the center hole 46 of the metering pin and the outlet orifice 20. As explained below, a central system may position the pin 16 at any point between the open position and the closed position to maintain a substantially constant gas flow.

Figure 3:
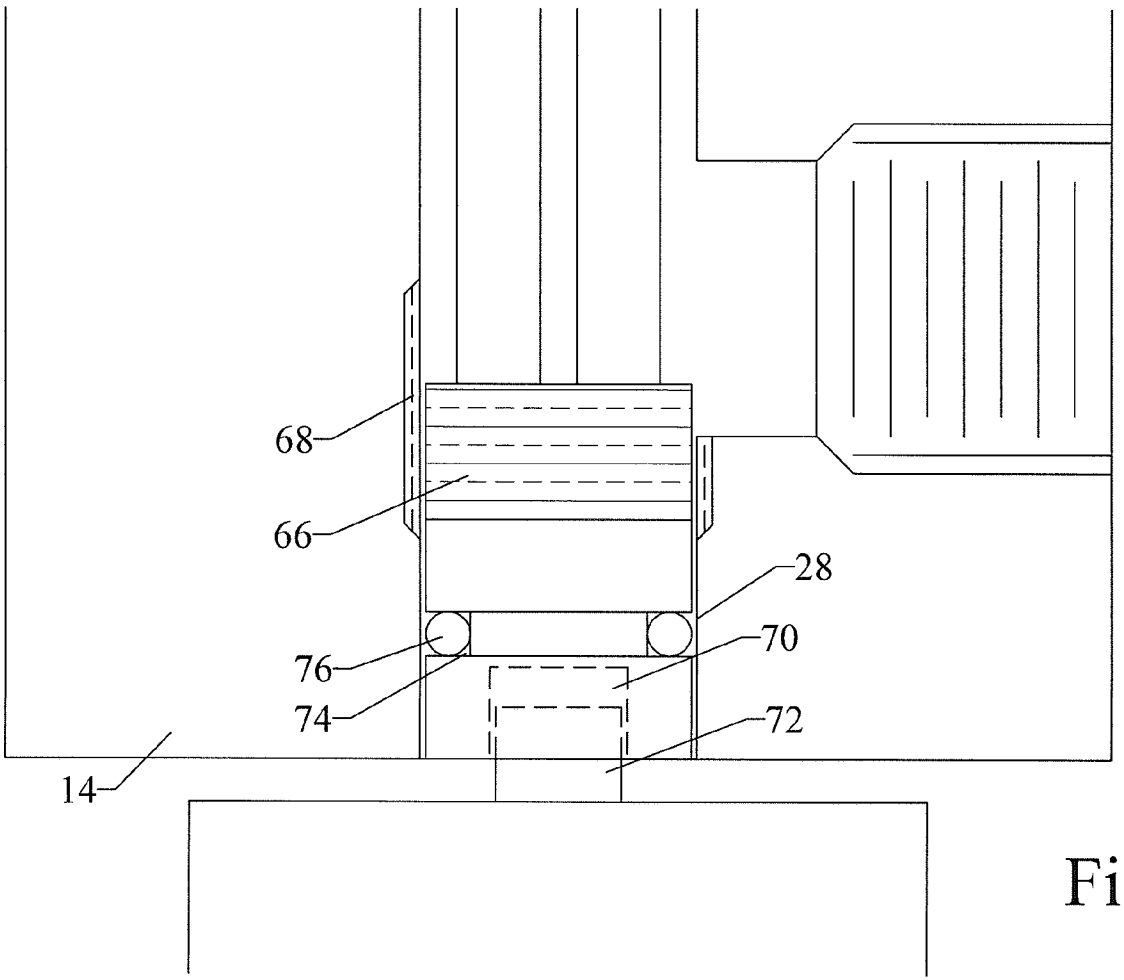
FIG. 3 is a side elevation view of a metering pin that may be used with the valve of FIG. 1.

An alternative construction of a metering pin 16 is illustrated in FIG. 3 having external threads 66 that assemble into matching internal threads 68 in the internal bore 28 of the gas fitting body 14, having a countersunk drive socket 70 on the first end for receiving a sliding fit external drive shaft 72 from the stepper motor, with an undercut groove 74 for receiving an o-ring 76 as a sealing member to provide a gas tight seal with internal bore 28 of the gas fitting body 14.

Figure 5:
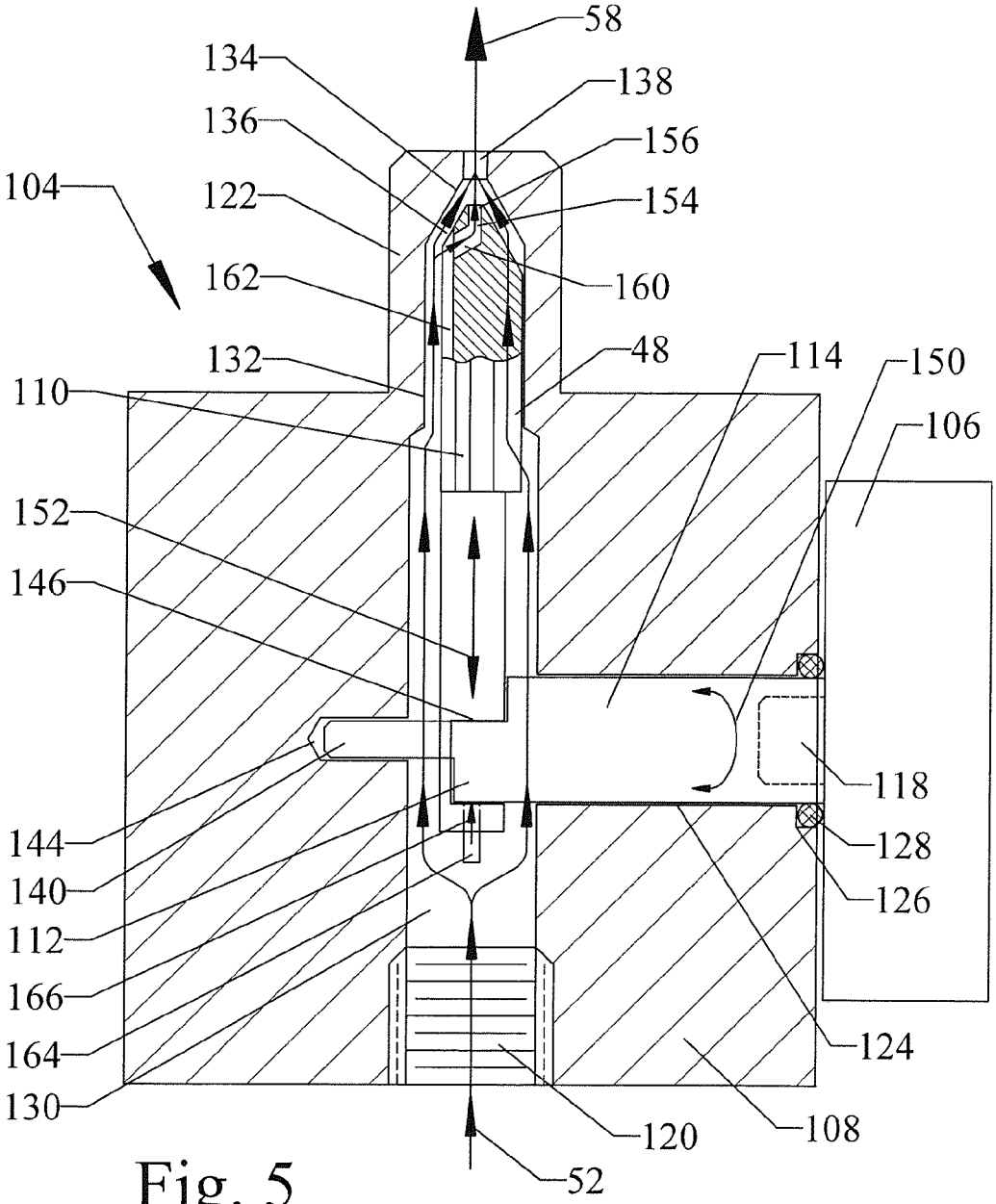
FIG. 5 is a variable orifice gas flow modulating valve incorporating principles of the present technology according to a second implementation, the valve including an actuator attached to a side of a gas fitting body.

Alternatively, a one-piece construction of a metering pin 16 could be used by, for example, machining the metering pin 16 and associated metering end 44 configuration directly on the end of the motor shaft 30, thus eliminating the assembly joint and associated manufacturing costs. A one-piece construction of the orifice hood 18 machined as part of the gas fitting body 14 is illustrated in FIG. 5.

The orifice hood 18 is illustrated in FIG. 1 inserted into a burner inlet port 78 of the gas oven burner 54. The burner 54 may have manually adjustable air-intake ports 80 providing primary air intake 82 during operation of the appliance. The volume of primary air intake 82 is related to the velocity of the exiting gas 58 and the resultant venturi action that it produces in the inlet area of the burner 54, this volume of primary air 82 facilitating complete combustion of the gas flow 58 at the burner 54. In other words, the exiting gas 58 causes a venturi action, and a greater venturi action causes more primary air to be drawn into the burner mixer tube, and more primary air may result in more complete combustion and the desired "hard blue" flame. As explained above in the section titled "RELATED ART," complete combustion is often a desirable attribute as it produces a hotter flame and prevents emission of incomplete combustion flue gases exhausting from the appliance, among other things.

The constant pressure gas flow 52 is delivered to the gas fitting body 14 through the gas supply line inlet connection 22. The gas passes through the inlet port 22 into the internal passageway portion 26, and then through the three gas passageways 50 formed by the fins 48 of the metering pin 16. It may be desirable to employ proven techniques, shapes, contours, profiles and clearances in the design of the gas passageways 24, 26, and 50 so that gas flow 52 to the metering pin end 44 is maximized, and the gas supply at point 64 is maintained at a constant pressure to facilitate maximum velocity of the gas flow 58 exiting the orifice 20 for improved combustion as previously discussed.

Figure 4:
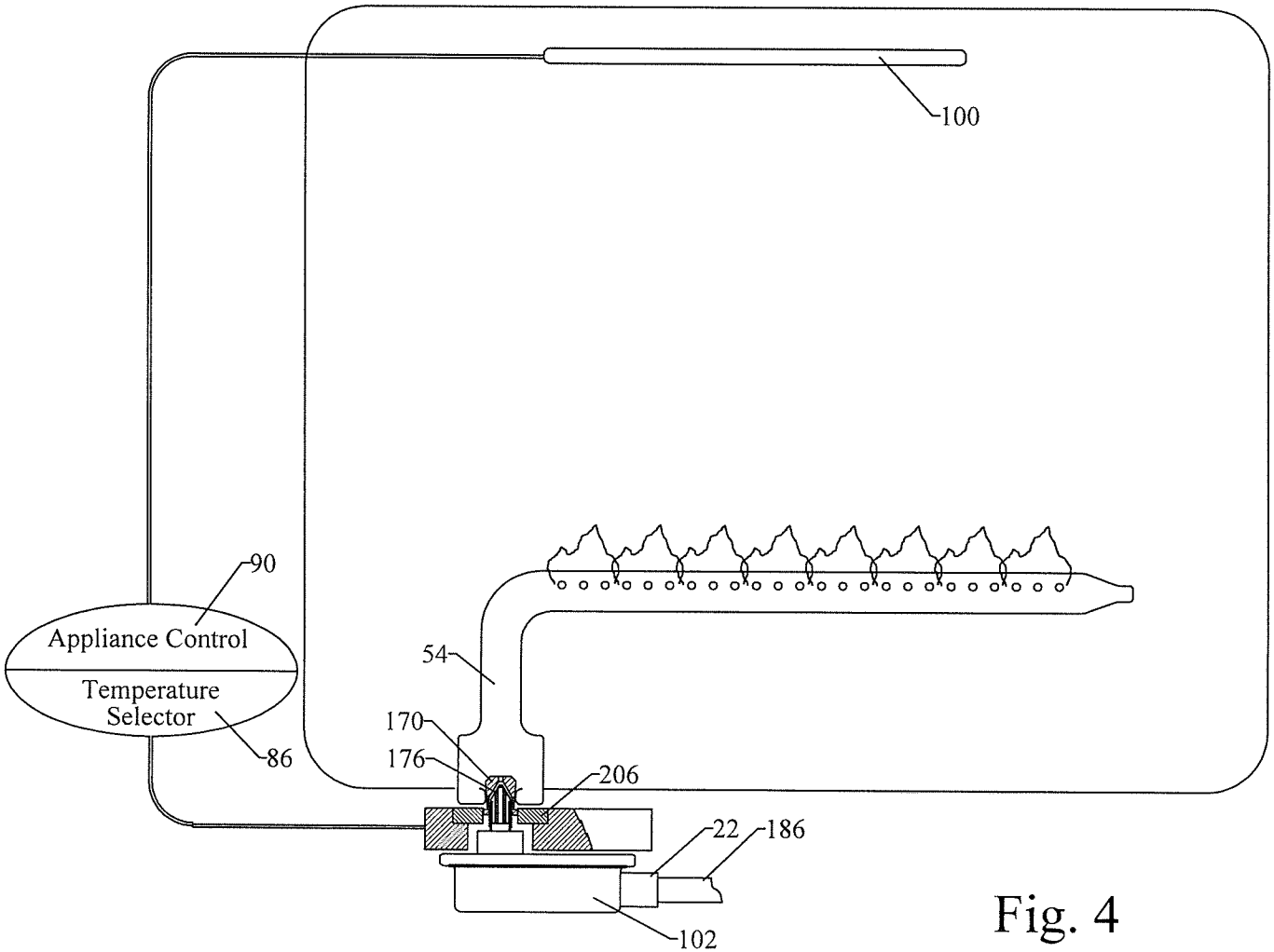
FIG. 4 is a schematic diagram of a gas appliance temperature control system including the valve of FIG. 8, a burner, and temperature controls.
Figure 14:
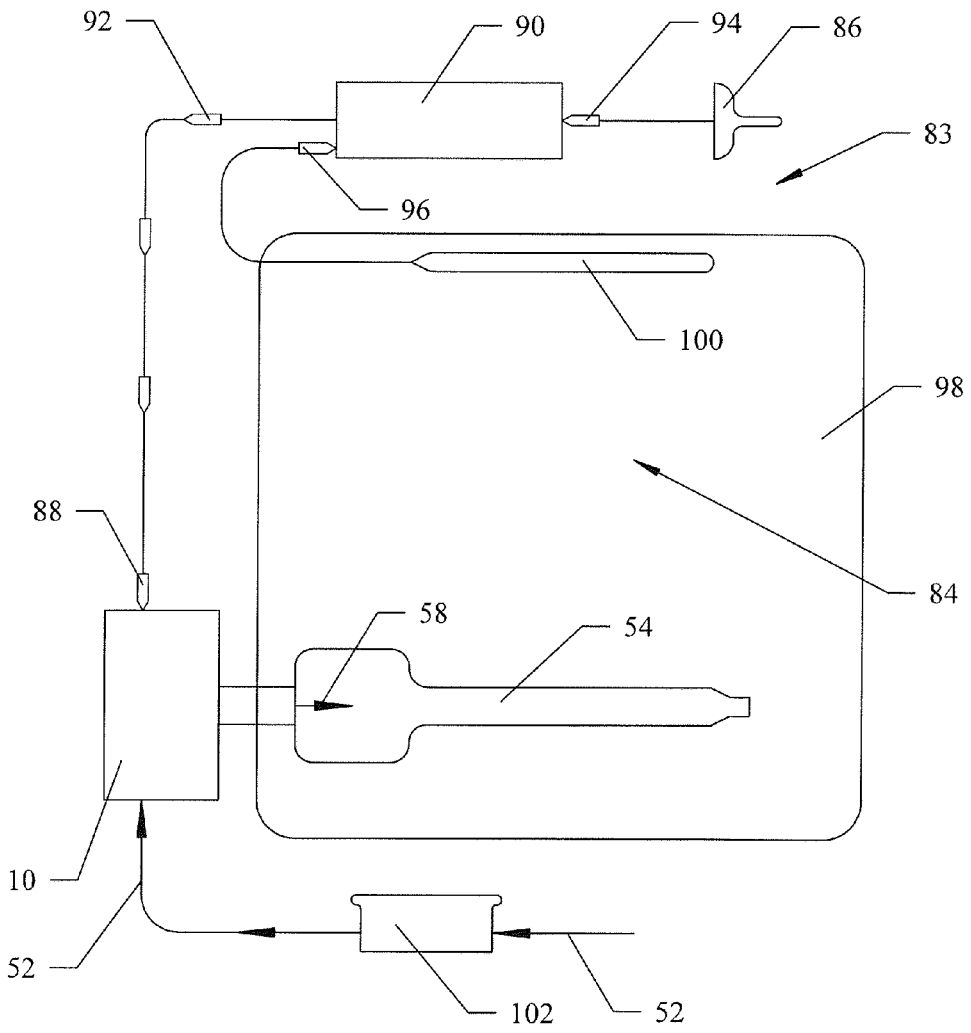
FIG. 14 is a schematic diagram of an exemplary temperature control system operable for use with any of the valves constructed according to principles of the present teachings.
Figure 16:
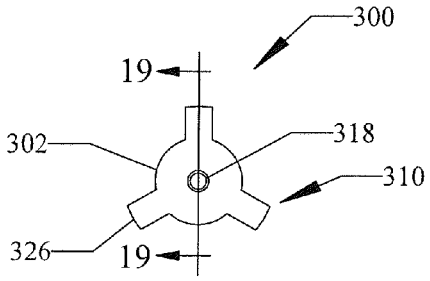
FIG. 16 is a top elevation view of the second embodiment of the metering pin.
Figure 18:
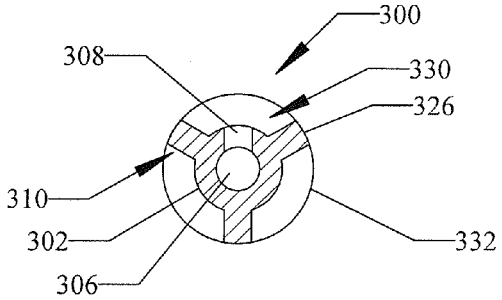
FIG. 18 is a horizontal plane sectional view of the second embodiment of the metering pin taken along line 18-18 of FIG. 15.
Figure 15:
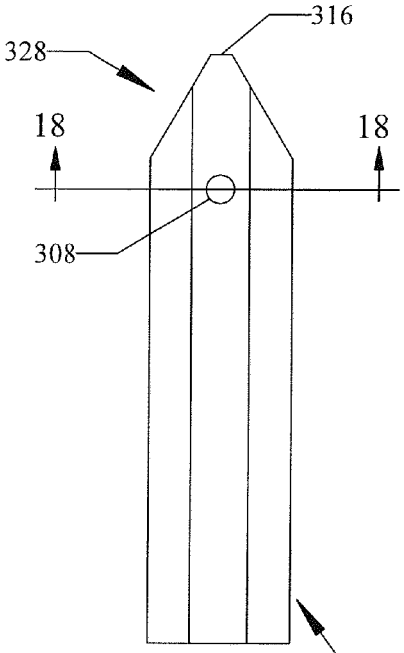
FIG. 15 is a side elevation view of a second embodiment of the metering pin.
Figure 19:
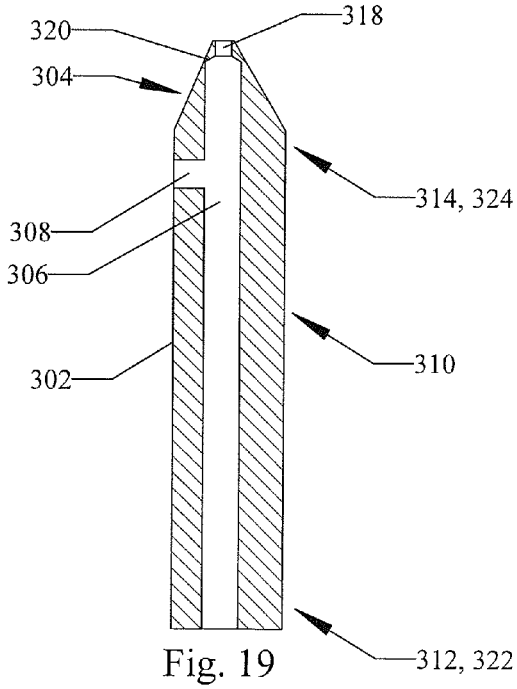
FIG. 19 is a vertical plane sectional view of the second embodiment of the metering pin taken along line 19-19 of FIG. 16.
Figure 17:
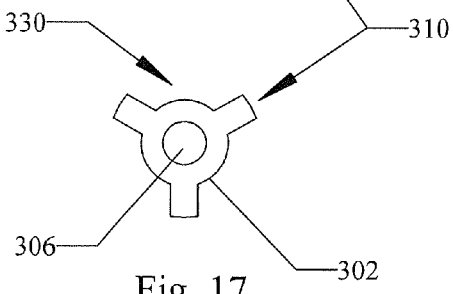
FIG. 17 is a bottom elevation view of the second embodiment of the metering pin.

FIGS. 4 and 14 illustrate an exemplary temperature control system 83 used in conjunction with one or more of the variable orifice gas flow modulating valve implementations of the present teachings. The temperature control system maintains a constant or substantially constant temperature in a gas appliance compartment 84 (such as, for example, an oven) as selected, for example, on the appliance temperature selector 86 by user. The temperature control system operates the actuator 12 to position the metering pin 16 within the orifice hood 18, thus controlling the volume of gas flow 58 allowed to pass through the orifice 20 into the burner 54 as determined by the position of the tapered portion of the metering end 44 of the pin 16 in relation to the tapered portion of the orifice hood countersink 62.

Thus, the control system is operable to maintain a substantially constant temperature in the gas appliance by positioning the actuator at any of a plurality of intermediate positions between an open position and a closed position. The actuator 12 output, and the resulting shaft 30 and metering pin 16 movement and position, is controlled by, and related to, a control signal input 88 from a programmable controller 90 whose output 92 is determined by calculations performed by the programmable controller 90 based on inputs 94 and 96 respectively from the temperature selector 86, typically located on a front panel of the gas appliance 98 for convenient human interface, and a temperature sensor 100 located in the gas appliance compartment 84. Thus, a constantly stable temperature is maintained, without the repeated cycling on and off of a gas control valve 102 as controlled by a conventional thermostat control system, by the application of a closed-loop, interactive control system comprised of a temperature selector 86, temperature sensor 100, programmable controller 90 and variable orifice gas flow modulating valve 10.

Figure 7:
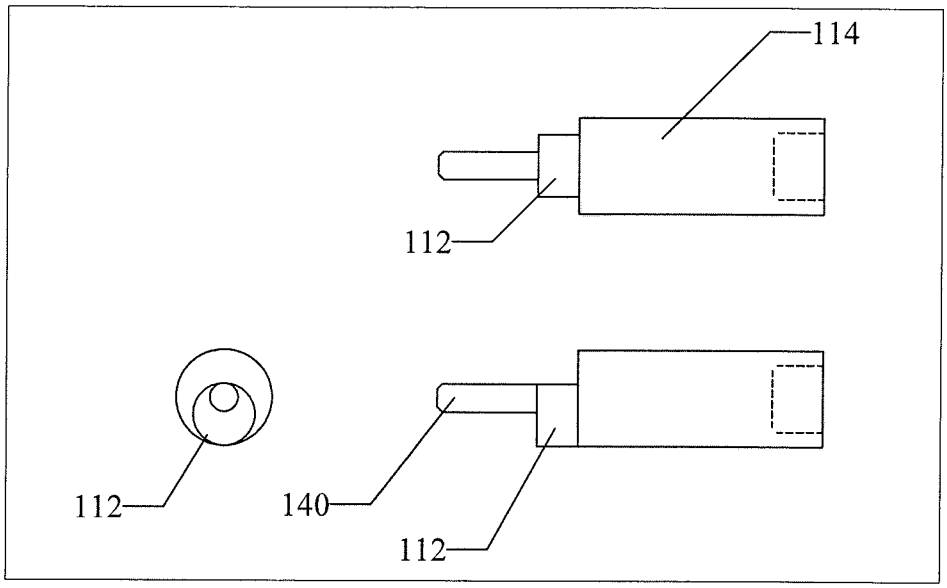
FIG. 7 is a cam element for use with the valve of FIG. 5, the cam element drivingly secured to the actuator and engaging the metering pin.
Figure 6:
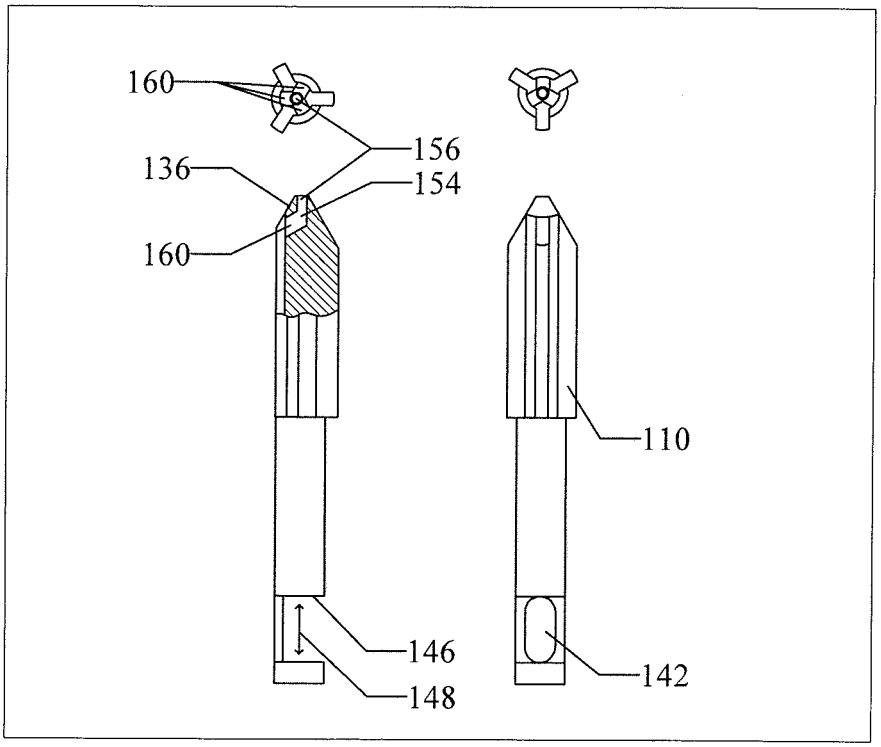
FIG. 6 is a metering pin for use with the valve of FIG. 5, the metering pin including an elongated slot for receiving a cam element connected to the actuator.

FIGS. 5-7 illustrate a gas flow modulating valve 104 incorporating principles of the present technology according to a second implementation. The valve 104 uses an actuator 106 attached to a side of a gas fitting body 108, generally perpendicular to a metering pin 110, with a cam 112 configuration on a drive shaft 114 for inducing a linear motion 152 to the metering pin 110.

The actuator 106 may be a servomotor, linear stepper motor, or any other type of a wide variety of electric devices that provide an electrically, variably controlled rotation of the output shaft. The servomotor 106 employed in this illustration is attached on the side of the gas fitting body 108 via normally acceptable means including rivets, screws, bolts or other equivalents in a manner such that an output shaft 118 centerline is axially perpendicular to and intersecting with the centerline of the metering pin 110.

The gas fitting body 108 is similar to that of FIG. 1 except having the gas inlet connection 120 on the opposite end from an outlet port 122, with a precision drilled hole 124 on the side of the gas fitting body 108 for assembly and alignment of the drive shaft 114, having an adjacent counterbore 126 for assembly of an o-ring 128 to provide a gas tight seal around the drive shaft 114, having a gas passageway 130 between the gas inlet connection 120 and the outlet port 122. The outlet port 122 could be of a similar construction as that of FIG. 1, with an orifice hood 18 assembled onto a threaded outlet port 36, or, as shown here, of an alternate one-piece construction, having an outlet port 122 with a precision machined bore 132 for alignment of a body diameter of the metering pin 110, having a precision machined countersink taper 134 of the same angle as the metering pin 110 end taper 136, with a precision drilled orifice hole 138 of a size to provide for the gas appliance specified maximum gas flow, and with an outside construction the same as that of the orifice hood 18 of FIG. 1 in order to properly assemble into a standard gas appliance burner inlet port.

A drive shaft 114 is assembled onto the output shaft 118 of the actuator 106 by some permanent, secure means such as threads, press fit, weld or cross-pin, having a precision machined diameter for alignment in the gas fitting bore 124 and gas tight sealing with the o-ring 128, with a small diameter end 140 for assembly through the metering orifice pin 110 elongated slot 142 and into the hole 144 of the gas fitting 108, and having the off-center precision machined cam 112 in a position to contact the surface 146 of the driving slot 148 on the metering pin 110 such that when rotated 180 degrees (see reference numeral 150) it will cause a linear movement 152 of the metering pin 110.

The metering pin 110 has an outside diameter for alignment in the gas fitting bore 132 having a machined tri-lobular cross-section for a gas passageway similar to the passageway 50, illustrated in FIG. 2, with the precision machined slot 148 for receiving the cam 112 of the drive shaft 114 and having the elongated slot 142 for engaging the drive shaft 114, and having an end construction the same as that of the metering pin 16 of FIG. 1, including the fins 48, an inside back hole 154, an orifice hole 156 sized to provide the specified minimum gas flow of the gas appliance, an end taper 136 of an angle matching the inside taper 134 of the outlet port 122, and having cross-drilled holes 160 or slots to provide a gas passageway 162 to the inside end of the metering pin orifice hole 138.

A spring pin 164 is assembled into the end of the metering pin 110 to maintain a constant pushing force 166 on the drive shaft to keep the cam 112 in constant contact with the driving surface 146 of the metering orifice pin 110 in order to prevent looseness or end-play between the cam 112 and the driving surface 146 during rotation 150 of the drive shaft 114.

A constant pressure gas flow 52 is delivered to the gas inlet connection 120 and through 162 the gas passageways to the orifice hole 138 for direct modulated flow 58 directly into the burner 54 for improved combustion as discussed above.

Referring to FIG. 14 for temperature control illustration purposes, constant temperature in the gas appliance compartment 84, as selected on the appliance temperature selector 86, is achieved similarly to FIG. 1 via an output signal 92 from the controller 90 being received by the actuator 106 causing a controlled rotation 150 of the drive shaft 114 and cam 112, imparting a linear motion 152 on the metering orifice pin 110, thus controlling the linear position of the metering orifice pin 110 end taper 136 in relation to the outlet port 122 countersink taper 134.

Figure 8:
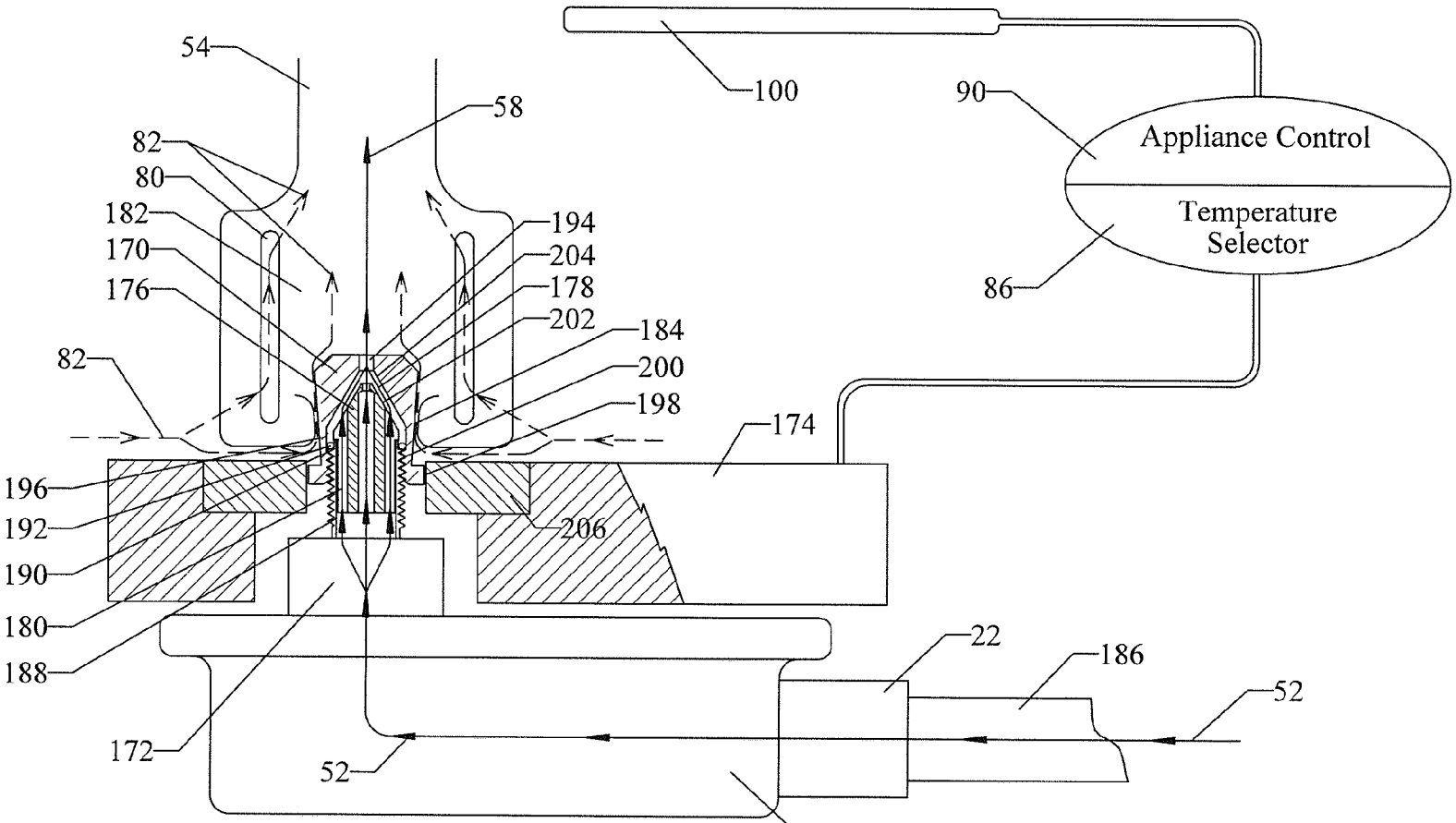
FIG. 8 is a variable orifice gas flow modulating valve incorporating principles of the present technology according to a third implementation, the valve including a fixed metering pin, a rotatable orifice hood threadedly secured to a gas valve body, and an actuator for rotating the orifice hood and thereby modulating gas flow through the valve.
Figure 9:
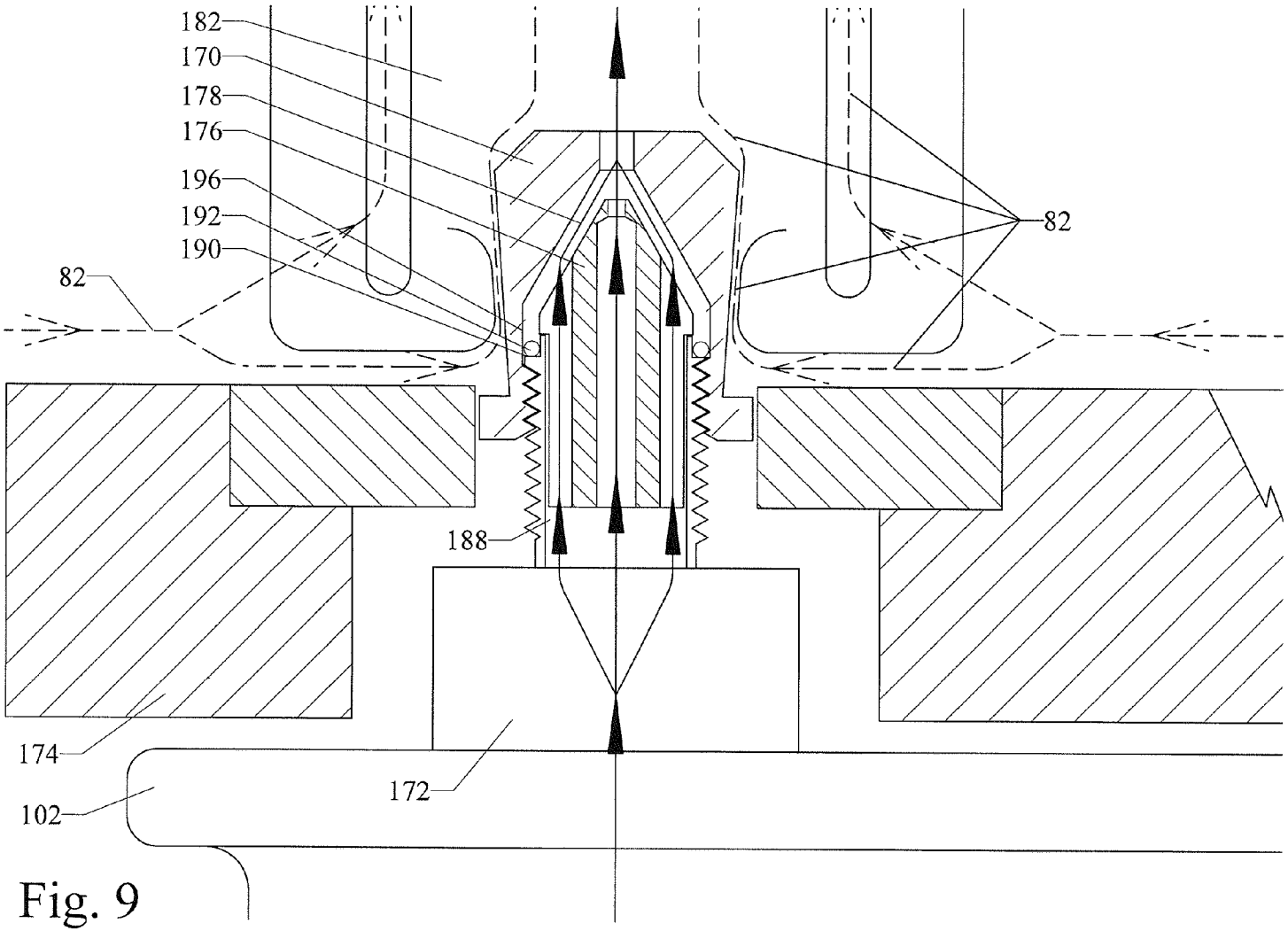
FIG. 9 is a cross-sectional view of a portion of the valve of FIG. 8, including the metering pin, orifice hood, and actuator.

FIGS. 8 and 9 illustrate a variation of the present invention that employs a reverse taper outer-diameter orifice hood 170 assembled onto an outlet port 172 of a gas safety valve 102 and incorporating a hollow shaft type electric motor actuator 174 to variably position the orifice hood 170 in relation to an orifice pin 176, effecting a metering action on the flow 58 to the burner 54, while still maintaining a constant pressure gas flow 52, 180, 178 immediately upstream of the orifice 170. It will be appreciated that the actuator 174 may alternatively be a pneumatic hollow shaft type actuator or any actuator operable to impart the desired movement to the hood 170, including custom actuators. As shown on the drawing, an additional feature of this invention is modulation of primary air flow 82 into a mixer tube 182 of the burner 54 as the orifice hood 170 is adjusted relative to the orifice pin 176, accomplished by the reverse taper 184 on an outer diameter of the orifice hood 170.

The gas safety valve 102 is comprised of a gas inlet connection 22 for connection to a gas supply line 186 attached to or integral with the gas appliance application, an outlet port 172 comprising a precision drilled hole 188 for an interference press fit assembly of the orifice pin 176, a machined shoulder 190 on the end of the outlet port 172 and external threads for assembly of the orifice hood 170.

An alternate construction could employ a gas fitting body 14 as described in FIG. 1 with modifications to the outlet port 172 as illustrated in FIG. 8 and described above, and without the opposite end hole 28 as shown in FIG. 1.

A sealing member 192, such as a conventional o-ring, is assembled onto the shoulder 190 of the outlet port 172 to create a gas tight or substantially gas tight seal between the orifice hood 170 and the outlet port 172.

The reverse taper orifice hood 170 has a reverse angle taper 184 on the outside diameter, a precision drilled orifice diameter 194 of a drilled size for providing the gas appliance with the maximum specified gas flow, a precision machined inside diameter surface 196 for a gas tight seal with the sealing member 192, a hexagon portion 198 to be used as a driving surface for turning down the orifice hood 170 towards the orifice pin 176, with internal threads 200 with a slip fit sufficient to allow free turning on the outlet port 172, and is assembled onto the outlet port 172 of the gas safety valve 102 with the sealing member 192 for a gas tight seal.

The orifice pin 176 is assembled into the outlet port 172 of the gas safety valve 102 with an interference press fit sufficient to hold the orifice pin 176 in place and in alignment with the orifice hood 170. The metering pin 176 may include fins similar to the fins 48 illustrated in FIG. 2 to create three gas passageways 50 for the gas flow 180 to pass through the gas fitting outlet 172 to enter the orifice 194 of the orifice hood 170. The metering taper end 202 of the orifice pin 176, and an internal countersink 204 of the orifice hood 170, are both machined with matching angle tapers, 202 and 204, such that the gas flow 178 approaching the orifice 194 is constricted, reducing or modulating the exiting gas flow 58, as the orifice hood 170 is turned down and approaches closer to the orifice pin end taper 202.

The actuator 174 is securely attached to the gas safety valve 102 via conventional means such as rivets, screws, bolts, clamps, brackets or other suitable means of permanent attachment. The hexagon driver socket 206 is assembled over the orifice hood 170 for rotating, or turning down, the orifice hood 170 to a controlled position with relation to the orifice pin 176 to meter the gas flow 178 based on an input signal from the gas appliance control system. The actuator 174 and driver socket 206 may be similar to what is commonly referred to in the art as a "nut runner."

A constant pressure gas flow 52 is delivered to the gas safety valve 102 through a gas supply line inlet connection 22, through the gas safety valve 102, and then through 180 the three gas passageways 50 (referring to FIG. 2) formed by the fins 48 of the orifice pin 176. Constant temperature in the gas appliance compartment is achieved through operation of the actuator 174 controlling the orifice hood 170 position in relation to the orifice pin 176, directly controlling the volume of gas flow 58 allowed to pass through the orifice 194 into the burner 54 as determined by the position of the orifice pin end 202 in relation to the orifice hood countersink taper 204. In addition to the normal drawing of primary air 82 through the mixer tube 182 air intake shutter 80, primary air 82 is further metered through the variable passageway between the orifice hood 170 reverse tapered 184 outside diameter and the mixer tube 182 inlet port. The actuator 174 rotation, and resulting orifice hood 170 movement and position, is linearly controlled by, and directly related to, a control signal input from a gas appliance control system whose output is determined by calculations based on inputs from a temperature selector and a temperature sensor located in the gas appliance compartment thus maintaining a constantly stable, non-fluctuating temperature in the gas appliance compartment through the direct modulation of the gas flow 58 and resultant turning down and modulation of the gas flame to supply the required heat to maintain the selected temperature, without the repeated cycling on and off of the gas safety valve 102 as controlled by a typical thermostat control system.

FIG. 4 is an illustration of a conventional residential gas range burner 54 with the orifice hood of FIGS. 8 and 9 positioned at least partially inside a burner inlet port. While FIG. 4 illustrates the combination of the burner 54 and the orifice hood 170 of FIGS. 8 and 9, the present teachings contemplate using the configuration of FIG. 4 with each of the gas valve implementations disclosed herein, wherein an orifice hood of the valve is placed at least partially within a burner inlet port, or opens directly into the burner inlet port.

Figures 10, 11:
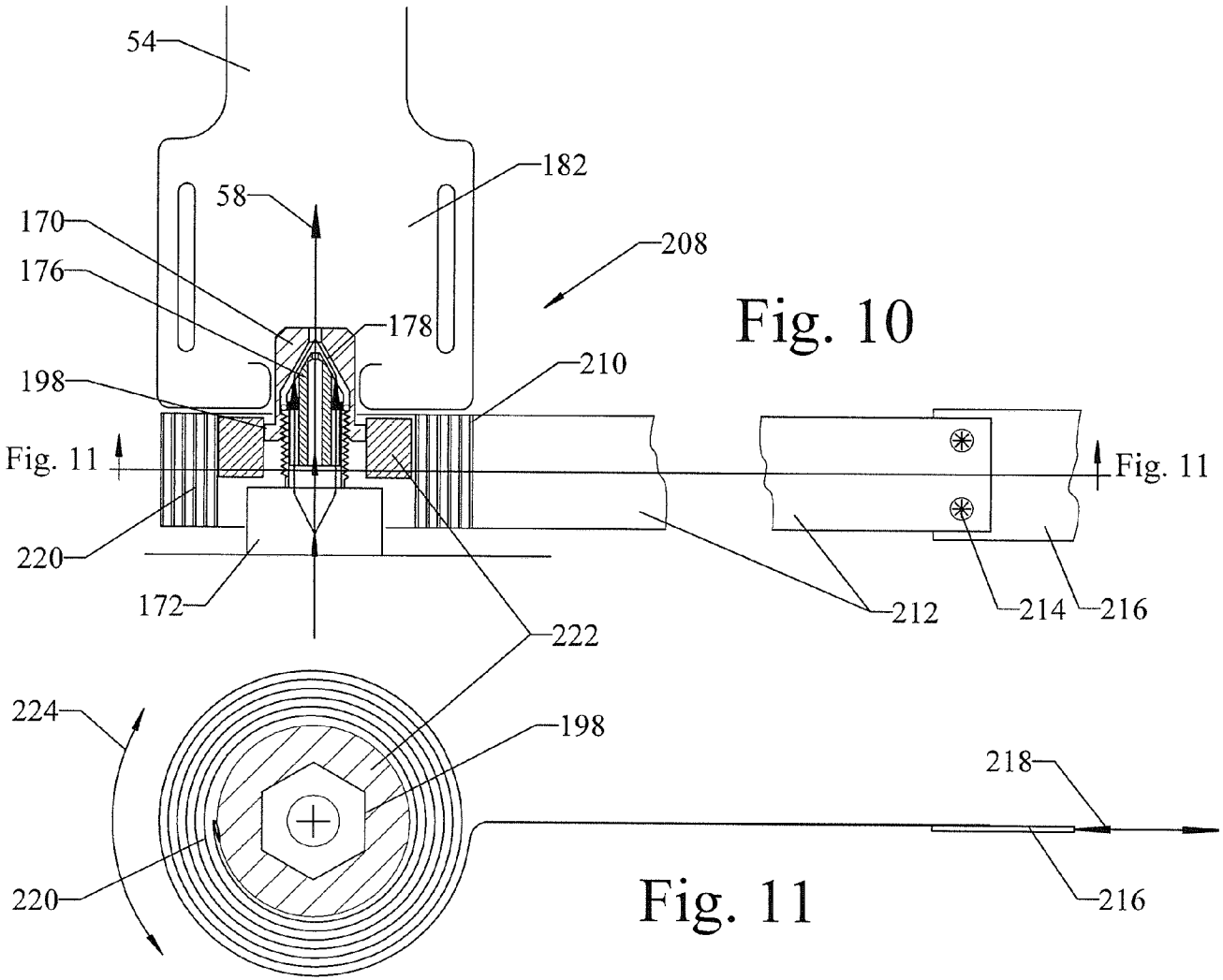
FIG. 10 is a side elevation view of a variable orifice gas flow modulating valve incorporating principles of the present technology according to a fourth implementation.
FIG. 11 is a cross-section view of the valve of FIG. 10 taken along line 11-11.

FIGS. 10 and 11 illustrate another variation of a variable orifice gas flow modulating valve 208 similar to that of FIGS. 8 and 9, except that the valve of FIGS. 10 and 11 includes the non-typical orifice hood 170 and further includes a bimetallic element actuator 210 positioned in the gas appliance working compartment, that responds to the actual ambient temperature in the compartment, and directly adjusts the orifice hood 170 in relation to the orifice pin 176 accordingly, thus metering the gas flow 178 and modulating the gas flow 58 directly into the mixer tube 182 of the burner 54.

The bimetallic element actuator 210 is comprised of a bimetallic strip 212, positioned in the gas appliance working compartment such that it responds to the actual ambient temperature in the compartment, attached by fasteners 214 to a temperature selector slide 216, that responds to an input signal 218 from the temperature selector device on the gas appliance, and terminates on the other end in a bimetallic coil 220 that is attached to a socket driver 222. The bimetallic element actuator 210 is positioned by a secure, permanent means onto an outlet 172 such that the socket driver 222 engages the hexagon surfaces 198 of the orifice hood 170. The bimetal strip 212 and bimetal coil 220 respond to temperature changes in an expansion and contraction manner, imparting a rotational movement 224 that turns the orifice hood 170 in response to temperature changes, resulting in a metering action on the gas flow 178 resulting in a constant, non-fluctuating temperature in the gas appliance as described in the FIG. 8 illustration.

One clear advantage of this variation is that it does not require electrical power to drive the actuator mechanism. It does, however, require an input, such as the input 218, either mechanical or electrical, from the gas appliance temperature selector in order to properly position the temperature selector slide 216.

Figure 12:
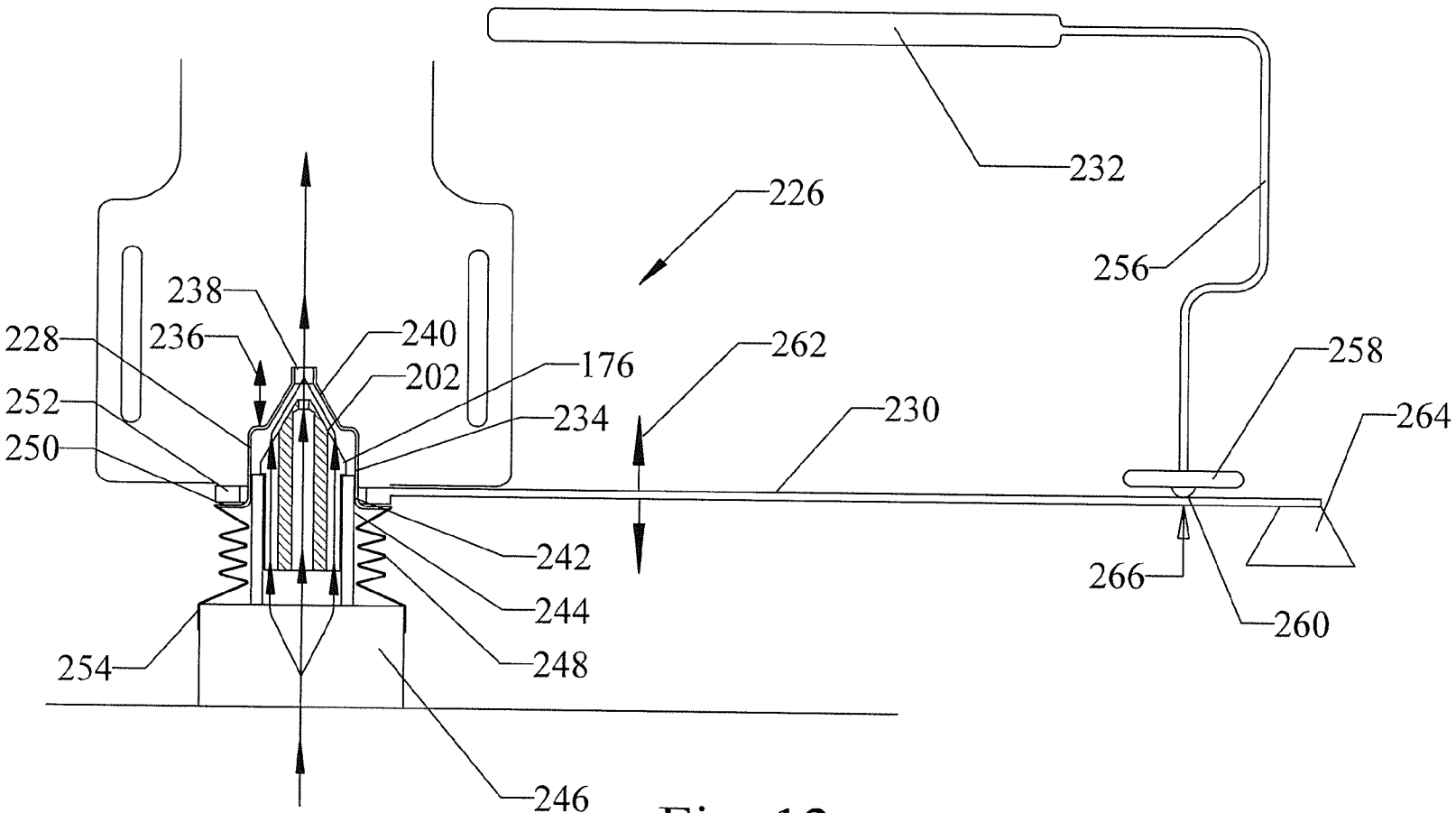
FIG. 12 is a side elevation view of a variable orifice gas flow modulating valve incorporating principles of the present technology according to a fifth implementation, the valve including a bellows-type design that permits use of a straight push linear motion from a lever operated by an actuator responding to a signal from a temperature controller.

FIG. 12 is a further variation of a variable orifice gas flow modulating valve 226 utilizing an orifice hood 228 in a bellows type design that permits use of a straight push linear motion from an actuator lever 230 responding to a temperature induced movement from a temperature sensor 232 positioned in the gas appliance compartment to perform a metering action on the gas flow.

This variation is comprised of the orifice hood 228 formed of a sufficiently thin material 234 as to allow a linear flexing movement 236, with a precision drilled or extruded fixed orifice hole 238, a countersunk angle taper 240 immediately adjacent to the inside end of the orifice hole 238, a precision drilled or formed inside diameter 242 adjacent to the end of the countersunk angle taper 240 to serve as an alignment surface 242 with the outside diameter 244 of the outlet port 246, a formed lower portion of a bellows 248 type construction designed to allow the linear flexing movement 236 of the orifice hood 228 to meter gas flow between the hood taper surface 240 and the orifice pin 176 end taper surface 202, a flat surface 250 to provide a contact surface with a lever actuator end 252, and a secure means of mounting, such as a seam weld 254, on the outlet port 246 providing a gas tight or substantially gas tight seal.

The orifice pin 176 is assembled with an interference fit in the outlet port 246 of either a gas safety valve or gas fitting body, as illustrated in FIG. 1.

The outlet port 246 may be the same as that illustrated in FIG. 8 and described above except without the external threads, instead having a precision machined surface 244 for axial alignment of the orifice hood 228 with the orifice pin 176.

The temperature sensor 232 is positioned in the gas appliance compartment such that it is responsive to the actual, ambient temperature of the compartment, having a capillary tube 256 attaching it to an expansion disk 258, and being filled with an expansion type fluid that responds in an expansion and contraction manner to temperature, with a contact point 260 for applying an expansion force onto the lever 230, imparting a linear motion 262 to the end 252 of the lever 230.

The lever 230 is fixed at one end 264 in the gas appliance compartment, having a contact point 260 of the expansion disk 258 in contact with the actuator lever 230 applying a linear force and resulting movement 262, with an opposing input force or signal 266 from the gas appliance temperature selector on the opposite side of the contact point 260, with the opposite end 252 in contact with the orifice hood 228 top surface 250 to provide the linear action 236 on the orifice hood 228 for linearly positioning the inside taper surface 240 of the orifice hood 228 at a fixed position with relation to the orifice pin 176 end taper surface 202 to meter gas flow through the orifice 238 into a burner mixer tube resulting in a constant, non-fluctuating temperature in the gas appliance as described in the FIG. 8 illustration.

Similar to the advantage described in FIGS. 10 and 11, this variation does not require electrical power to operate the actuator mechanism, but it does require an opposing adjustment means, either mechanical or electrical, from the gas appliance temperature selector in order to provide an input 266 to properly compensate for the temperature in the gas appliance compartment.

A further variation of this method may employ either an electromagnetic solenoid, electric linear stepper motor, or other similar electrical device that provides a variably controllable linear force or motion 236 on the orifice hood 228 flat surface 250.

Figure 13:
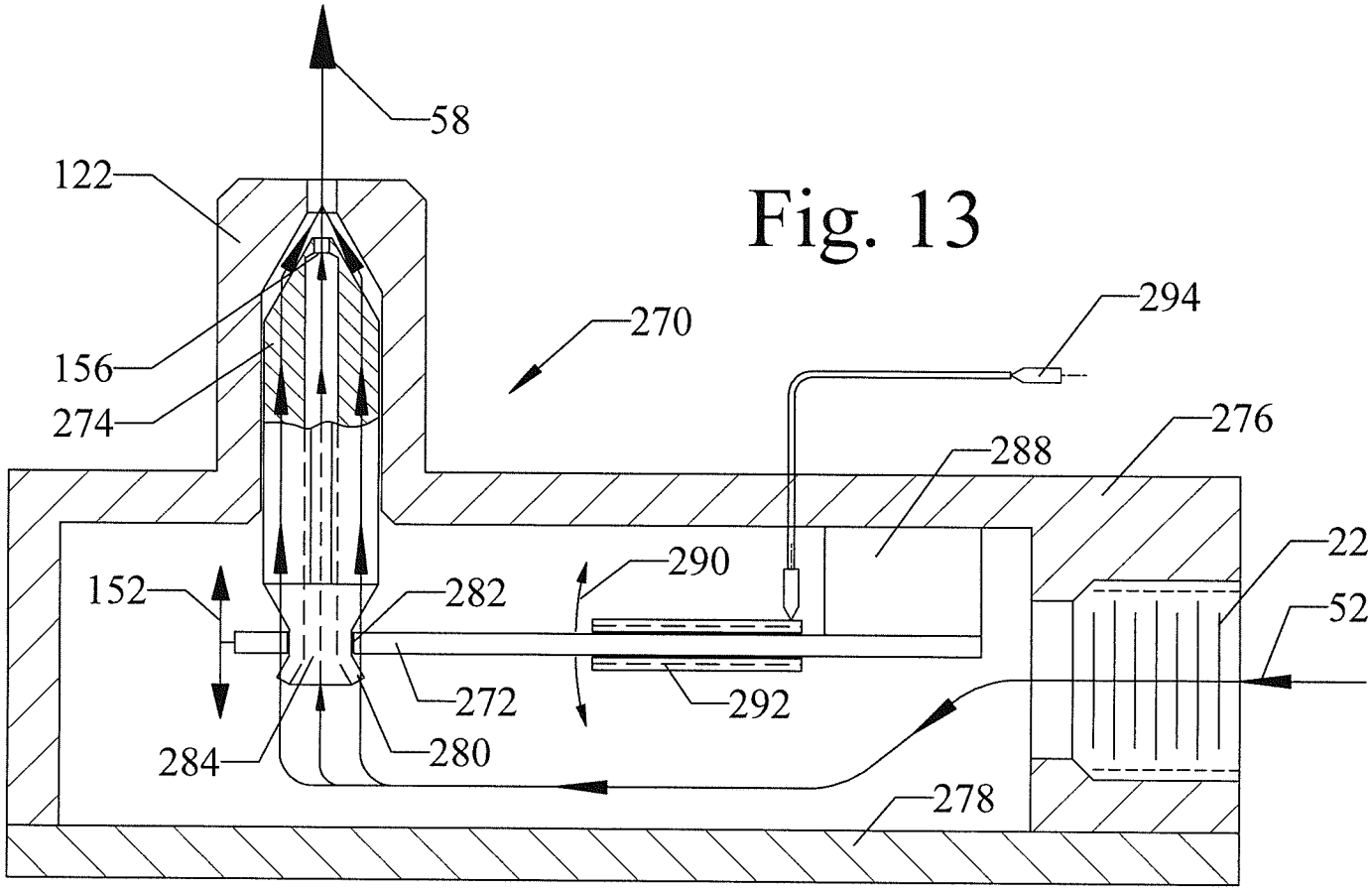
FIG. 13 is a side elevation view of a variable orifice gas flow modulating valve incorporating principles of the present technology according to a sixth implementation, the valve including a fixed orifice hood and a bimetallic lever.

FIG. 13 is a further variation of a variable orifice gas flow modulating valve 270 including a fixed orifice hood 122 similar to that illustrated in FIG. 5, and further having an internal bimetallic lever 272 providing linear motion to the orifice metering pin 274.

The valve 270 is comprised of a valve body 276 having an inlet port 22 and one-piece outlet port orifice hood 122 as previously described and illustrated in FIG. 5. The valve body 276 additionally has one open side to allow assembly of internal components, then being assembled with a cover 278 to provide a gas tight seal, though not limited to this embodiment as other normal manufacturing methods could permit assembly of the internal bimetallic lever 272 without having the open side and cover 278, such as inserting the lever 272 through an open port from the side. The orifice hood 122 outlet port is the same construction as that described in FIG. 5, including the precision orifice hole and internal taper for metering gas flow as previously described and illustrated in FIG. 5.

The metering pin 274 is a similar construction as that described above and illustrated in FIG. 5, except having one end machined for assembly 280 to the end hole 282 of the bimetallic lever 272 via the coin-over 280 as illustrated in FIG. 13, or any other conventional manufacturing methods such as threads, screws, bolts, rivets, pins, stakes, weld links, and so forth. In addition, the metering pin 274 has a back hole 284 providing an internal gas passageway to the inside end of the metering pin orifice hole 156. The other end of the metering pin 274 is the same as that described above and illustrated in FIG. 5, including the tri-lobular construction and end taper.

The valve 270 has an internal bimetallic lever 272, securely attached to a valve body 276 via an internal surface or mounting block 288, for providing linear motion to the metering pin 274 assembled to the hole 282 in the end. The bimetal lever 272 is of a bimetallic material that responds with a bending motion 290, resulting in a controlled linear motion 152 at the end of the lever 272, when heat is applied via an electrical heater coil 292 that is supplied a controlled variable electrical signal 294 from a temperature control system, such as the system illustrated in FIG. 14 and described above.

A constant pressure gas flow 52 is delivered to the gas fitting body 276 through a gas supply line inlet connection 22. Modulated gas flow 58 for control of temperature in a gas appliance is accomplished in a similar manner as previously described and illustrated in FIG. 5 and as illustrated in the temperature control system in FIG. 14.

As explained above, FIG. 14 is an illustration of an exemplary temperature control system for a gas appliance, the system utilizing a variable orifice gas flow modulating valve of any of the previously described configurations directly responding to a sensed temperature, in relation to a selected temperature, and modulating the gas flow, thus the flame and heat output, shown for illustrative purposes in application on a residential gas oven 98. This description is non-limiting and solely for the purpose of illustration, and as such could be easily applied in principle to other gas appliances such as gas furnaces, gas water heaters, gas-fired boilers, gas grills, gas commercial ovens, and other similar gas appliances using gas controls.

Constant temperature in the gas appliance compartment 84, as selected on the appliance temperature selector 86, is achieved through operation of the actuator 12 (see FIG. 1 for component details) controlling metering pin 16 positioning within the orifice hood 18, directly controlling the volume of gas flow 58 through the orifice 20 into the burner 54 as determined by the position of the metering pin end 44 in relation to the orifice hood countersink 62. The actuator 12 output, and resulting shaft 30 and metering pin 16 movement and position are controlled by, and related to, the control signal input 88 from the programmable controller 90 whose output 92 is determined by calculations performed by the programmable controller 90 based on inputs 94 and 96, respectively, from the temperature selector 86, typically located on a front panel of the gas appliance 98 for convenient human interface, and a temperature sensor 100 located in the gas appliance compartment 84. This signal could be a variable value such as, for example, 4-20 milliamps for positioning an actuator in direct proportion to the value of the signal, or a single signal, repeated a certain amount as necessary, applied to a stepping device to cause it to incrementally move or step a proportional amount and direction. Thus a constantly stable temperature is maintained through direct modulation of the gas flow and flame, without the repeated cycling on and off of the gas control valve 102 as controlled by a typical thermostat control system, by the application of a closed-loop, interactive control system comprised of a temperature selector 86, temperature sensor 100, programmable controller 90 and variable orifice gas flow modulating valve 10.

A second embodiment of the metering pin 300 is shown in FIGS. 15-20. The metering pin 300 may be utilized with the gas valve 10 of FIGS. 1-3 and may be similar to the metering pin 16. The metering pin 300 may include a sidewall 302, a head 304, a center hole 306, a lateral hole 308, and a plurality of fins 310. The sidewall 302 may be generally cylindrical in shape and elongated with a length that is generally greater than its diameter and may have a first end 312 and a second end 314. The head 304 may be coupled to the second end 314 of the sidewall 302 and may be tapered, having a frustoconical shape with a planar endwall 316. The head 304 may also include an exit hole 318 that extends from the endwall 316 to the interior and is of cylindrical shape.

The center hole 306 is a bore on the interior of the metering pin 300 that is axially aligned with the sidewall 302, extending from the first end 312 of the sidewall 302 to the interior of the head 304. The diameter of the center hole 306 may be at least 10% greater than the diameter of the exit hole 318 in the head 304 such that the gas flow 52 and the gas flow 56 are not restricted prior to arriving at the exit hole 318. Thus, the head 304 may further include an internal neck 320 positioned between the center hole 306 and the exit hole 318 which tapers from the diameter of the center hole 306 to the diameter of the exit hole 318. The center hole 306 may extend from the first end 312 of the sidewall 302 in order to facilitate the manufacture of the center hole 306 utilizing a drilling, machining, extrusion or other common fabrication process. Further, the center hole 306 may extend a length of the metering pin 300 to be coupled with the exit hole 318 to within a sufficiently close proximity of the endwall 316 such that the length of the exit hole 318 is within the generally acceptable design guidelines for a precision orifice in the gas appliance industry.

The lateral hole 308 is a bore through the sidewall 302 from the exterior to the center hole 306. The lateral hole 308 may be of a diameter that is at least 10% larger than the diameter of the exit hole 318, such that the flow of gas is not restricted, or substantially reduced, such that the pressure of the gas flow 56 at the entry of the exit hole 318 is substantially the same as the pressure of the gas flow 52 at the entry of the gas inlet connection 22. The lateral hole 308 may be of cylindrical shape, although other cross-sectional shapes are possible such as triangular, rectangular, square, etc. with the cross-sectional area of the shape being at least 10% larger than the area of the exit hole 318. In various embodiments, the lateral hole 308 may be positioned in proximity to the head 304, although the lateral hole 308 could be positioned at any point on the sidewall 302. Furthermore, in some embodiments, the metering pin 300 may include more than one lateral hole 308, with the sum of the cross-sectional areas of the plurality of lateral holes 308 being at least 10% larger than the cross-sectional area of the exit hole 318. The additional lateral holes 308 may be positioned on the sidewall 302 at the same distance from the head 304 as the first lateral hole 308 or they may be positioned at any point on the sidewall 302.

The fins 310 may be generally elongated with a length that is greater than their cross-sectional area and may be coupled to the sidewall 302. Each fin 310 may include a first end 322 that aligns with the first end 312 of the sidewall 302 and a second end 324 that includes an angled taper which aligns with the taper of the head 304. Each fin 310 may also include an outer surface 326 that is precision machined, or otherwise manufactured, in a curved or arcuate manner such that the outer surface of the fins 310 may align with the circumference of a circle with a diameter greater than that of the sidewall 302. In an exemplary embodiment, the metering pin 300 includes three fins that are evenly spaced along the circumference of the sidewall 302. In other embodiments, there may be a different number of fins 310 that are uniformly or non-uniformly spaced along the circumference of the sidewall 302.

In various embodiments, the metering pin 300 may be of monolithic construction from a single piece of material, typically a metal, such that the material is machined to create the fins 310 and the center hole 306, the lateral hole 308, and the exit hole 318 are drilled or machined. The outer surfaces 326 of the fins 310 may be manufactured such that a circumscribed circle of the outer surfaces 326 forms a precision circumference 332 that extends from the first end 322 of each fin 310 to the second end 324 of each fin 310. The outer surfaces 326 of the plurality of fins 310 may further be manufactured such that the circumcenter of the outer surfaces 326, from the first end 322 extending to the second end 324 of the fins 310, is in axial alignment to the axial centerline of the center hole 306.

Figure 20:
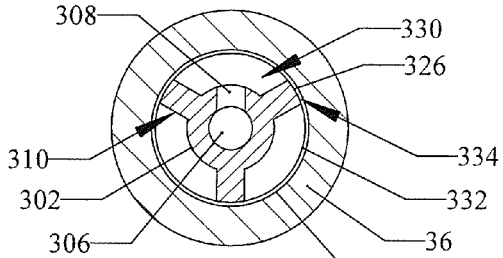
FIG. 20 is a horizontal plane sectional view of the second embodiment of the metering pin employed in an outlet port of the valve of FIG. 1.

As mentioned above, the metering pin 300 may be implemented in the gas valve 10 of FIGS. 1-3. As with the metering pin 16, the metering pin 300 may be coupled to the actuator 12 through the actuator shaft 30 and thus, may be positioned within the second portion 26 of the internal passageway of the gas fitting body 14. In addition, as shown in FIG. 20, the metering pin 300 includes a metering end 328 that may be positioned within the precision-machined bore 38 of the orifice hood 18, such that the exit hole 318 is axially aligned with the outlet orifice 20 and the head 304 and the tapered ends of the fins 310 may be in proximity to the internal countersink 62. Accordingly, the circumference 332 of the metering pin 300, as determined by the outer surfaces 326 of the fins 310, may be slightly less than the circumference of the bore 38 so that there is a small gap 334 between the outer surfaces 326 and the bore 38. The gap 334 should be such that it provides a precision sliding fit that maintains precision axial alignment of the exit hole 318 to the outlet orifice 20 and does not prevent, or inhibit in any way, free sliding movement of the outer surfaces 326 of the fins 310 of the metering pin 300 within the precision machined bore 38 of the outlet port 36 of the gas fitting body 14. Furthermore, the space between the fins 310 adjacent to the sidewall 302 defines a plurality of gas flow paths 330.

The gas valve 10 of FIGS. 1-3 with the metering pin 300 may operate as follows. The metering pin 300 may be positioned at a default position within the gas fitting body 14 and the orifice hood 18 such that the head 304 is at a small distance from the internal countersink 62. Gas may enter the gas valve 10 through the inlet connection 22, flowing along path 52. Gas may flow into the internal passageway 26 of the gas fitting body 14 along the gas flow paths 330 between the fins 310. Gas may continue to flow past the head 304 and may exit the orifice hood 18 through the outlet orifice 20. A portion of the gas may flow into the lateral hole 308 and fill the center hole 306 of the metering pin 300. The gas may also flow through the exit hole 318 and out of the orifice hood 18 through the outlet orifice 20. The portion of the gas flow 56 passing through the center hole 306, is maintained at the same constant pressure of gas flow 52 entering at inlet connection 22, through the sufficient sizing of each of the lateral hole 308 and the center hole 306, such that there is not a significant drop in the pressure of the gas flow 52 that is delivered from the inlet connection 22, through the lateral hole 308, to the internal neck 320 at the interior side of the exit hole 318. This increased pressure of the gas flow 56 may aid or add to the velocity of the exiting gas stream at flow path 58 which may increase or maximize the volume of primary air intake 82 drawn into the mixing chamber of the burner 54 which may result in improved and more complete combustion.

If a greater gas flow rate through the gas valve 10 is desired, then the actuator 12 may be energized to move the metering pin 300 away from the internal countersink 62 of the orifice hood 18. If a smaller gas flow rate is desired, then the actuator 12 may be energized to move the metering pin 300 closer to the internal countersink 62 of the orifice hood 18.

In some instances, the metering pin 300 may be moved to a closed position in the orifice hood 18, wherein the head 304 is seated against the internal countersink 62. In such instances, the gas flow rate is at its minimum with gas only being able to flow along path 52 and gas flow paths 330 to the one (or more) lateral holes 308. The gas may then flow to the center hole 306 and the exit hole 318 and finally, out of the orifice hood 18 through the outlet orifice 20. The exit hole 318, being in axial alignment with the outlet orifice 20, maintains a substantially centered and circular gas flow 58 exiting the outlet orifice 20, throughout the full range of intermediate flow rates described above, and including at this minimum flow rate in the closed position. Further, as previously described, the gas flow 58 is delivered through the exit hole 318 at full system pressure, centered through the outlet orifice 20, such that the gas flow 58 fuel jet stream enters the burner 54 at maximum velocity.

As previously described, the volume of primary air intake 82 is related to the velocity of the exiting gas 58 and the resultant venturi action that it produces in the inlet area of the burner 54, this volume of primary air 82 facilitating complete combustion of the gas flow 58 at the burner 54. In other words, the maximum velocity exiting gas 58, being in an optimally centered and circular profile, causes a greater venturi action, and a greater venturi action causes more primary air to be drawn into the burner mixer tube, and more primary air may result in more complete combustion. More complete combustion is often a desirable attribute as it produces a hotter flame and prevents emission of incomplete combustion flue gases exhausting from the appliance, among other things.

Although the invention has been described with reference to the preferred embodiments illustrated in the attached drawings, it is noted that equivalents may be employed and substitutions made herein without departing from the scope of the invention as recited in the claims.

Having thus described a preferred embodiment of the invention, what is claimed as new and desired to be protected by Letters Patent includes the following:

1. A metering pin for use with a gas valve, the metering pin comprising:
   - a sidewall of cylindrical shape, the sidewall including a first sidewall end, a second sidewall end, an axially-aligned center hole with a first diameter extending the entire length of the sidewall, and a lateral hole with a second diameter extending from the exterior of the sidewall to the center hole;
   - a head coupled to the second sidewall end, the head having a tapered frustoconical shape with a planar endwall that includes an exit hole with a third diameter that couples to the center hole, wherein the first diameter and the second diameter are at least 10% larger than the third diameter; and
   - a plurality of fins coupled to the sidewall, each fin having a first fin end aligned with the first sidewall end, a second fin end with a taper that aligns with the taper of the head and a surface extending from the first fin end to the second fin end;
     - wherein the surface of the fins forms an outside circumference at the first fin end and extending with the same circumference to the second fin end.

2. The metering pin of claim 1, wherein the head further includes a neck that connects the center hole to the exit hole which tapers from the first diameter to the third diameter.

3. The metering pin of claim 1, wherein the fins are spaced apart on an exterior surface of the sidewall.

4. The metering pin of claim 1, wherein the metering pin includes three fins spaced uniformly along the circumference of the sidewall.

5. The metering pin of claim 1, wherein the lateral hole is positioned on the sidewall adjacent to the head.

6. A variable orifice gas flow modulating valve comprising:
   - an orifice hood with an outlet orifice of small diameter that extends from the exterior of the orifice hood to the interior thereof, an internal bore having a relatively larger diameter, and an internal countersink having a taper that couples the outlet orifice to the internal bore;
   - a gas fitting body with a gas inlet port and an internal passageway connected thereto, the internal passageway aligned with and coupled to the internal bore of the orifice hood;
   - a metering pin positioned within the internal passageway and the internal bore, the metering pin including:
     - a sidewall of cylindrical shape, the sidewall including a first sidewall end, a second sidewall end, an axially-aligned center hole with a first diameter extending the entire length of the sidewall, and a lateral hole with a second diameter extending from the exterior of the sidewall to the center hole,
     - a head coupled to the second sidewall end, the head having a tapered frustoconical shape with a planar endwall that includes an exit hole with a third diameter that couples to the center hole, wherein the first diameter and the second diameter are at least 10% larger than the third diameter, and
     - a plurality of fins coupled to the sidewall, each fin having a first fin end aligned with the first sidewall end, a second fin end with a taper that aligns with the taper of the head and a surface extending from the first fin end to the second fin end,
       - wherein the surface of the fins forms an outside circumference at the first fin end and extending with the same circumference to the second fin end, and
       - a gap is formed between the surfaces of the plurality of fins and the internal bore of the orifice hood; and
   - an actuator coupled to the metering pin and operable to move the metering pin along the internal passageway and the internal bore.

7. The variable orifice gas flow modulating valve of claim 6, wherein the taper of the head matches the taper of the internal countersink.

8. The variable orifice gas flow modulating valve of claim 6, wherein the actuator is operable to move the metering pin to a closed position in which the tapered surface of the head is flush against the tapered surface of the internal countersink.

9. The variable orifice gas flow modulating valve of claim 8, wherein gas flow from the internal bore of the orifice hood to the outlet orifice is restricted to flowing through the lateral hole, the central hole, and the exit hole.

10. The variable orifice gas flow modulating valve of claim 6, wherein the head of the metering pin further includes a neck that connects the center hole to the exit hole which tapers from the first diameter to the third diameter.

11. The variable orifice gas flow modulating valve of claim 6, wherein the fins of the metering pin are spaced apart on an exterior surface of the sidewall.

12. The variable orifice gas flow modulating valve of claim 6, wherein the metering pin includes three fins spaced uniformly along the circumference of the sidewall.

13. The variable orifice gas flow modulating valve of claim 6, wherein the lateral hole is positioned on the sidewall adjacent to the head.

* * * * *